US005469969A

United States Patent [19]

Huang

[11] Patent Number: 5,469,969

[45] Date of Patent: Nov. 28, 1995

[54] SELF-OPENING PLASTIC BAG PACK SYSTEM

[75] Inventor: Frank F. J. Huang, Irvine, Calif.

[73] Assignee: Durabag, Inc., a California corporation, Tustin, Calif.

[21] Appl. No.: 206,191

[22] Filed: Mar. 1, 1994

Related U.S. Application Data

[63] Continuation of Ser. No. 932,333, Aug. 19, 1992, abandoned, which is a continuation-in-part of Ser. No. 904,446, Jun. 25, 1992, abandoned.

[51] Int. Cl.[6] ..... B65D 33/14

[52] U.S. Cl. ..... 206/554; 248/100

[58] Field of Search ..... 206/554; 248/100

[56] References Cited

U.S. PATENT DOCUMENTS

| | | | |
|---|---|---|---|
| Re. 33,264 | 7/1990 | Baxley et al. | 206/554 |
| 5,087,234 | 2/1992 | Prader et al. | 493/194 |
| 5,188,235 | 2/1993 | Pierce et al. | 206/554 |

*Primary Examiner*—Joseph M. Moy
*Attorney, Agent, or Firm*—Drucker & Sommers

[57] ABSTRACT

A self-opening pack of plastic bags for use with a bagging rack. The pack of plastic bags is formed of plastic material which has been exposed to corona surface treatment. Each plastic bag in the pack of bags has a central tab portion between its two upwardly extending handles, which are at the sides of the mouth of the T-shirt bags. A central tab portion is located on the front and rear walls in the mouth region of the plastic bags. The central tab portion has an aperture for receiving a retaining hook of a bagging rack, and a tearing cut which extends across the central tab portion, except for uncut portions near side edges of the central tab. The tearing cuts pass through the stack of bags and follow a non-straight path. Frangible pressure bonding is found along both sides of said tearing cut. Frangible pressure bonds are also formed on inner handle edges or edges of apertures or flaps formed in the stack of handles. When the top bag is removed from the bagging rack, the next bag in the pack of bags will self-open into a open position for loading with merchandise.

21 Claims, 6 Drawing Sheets

Fig. 1
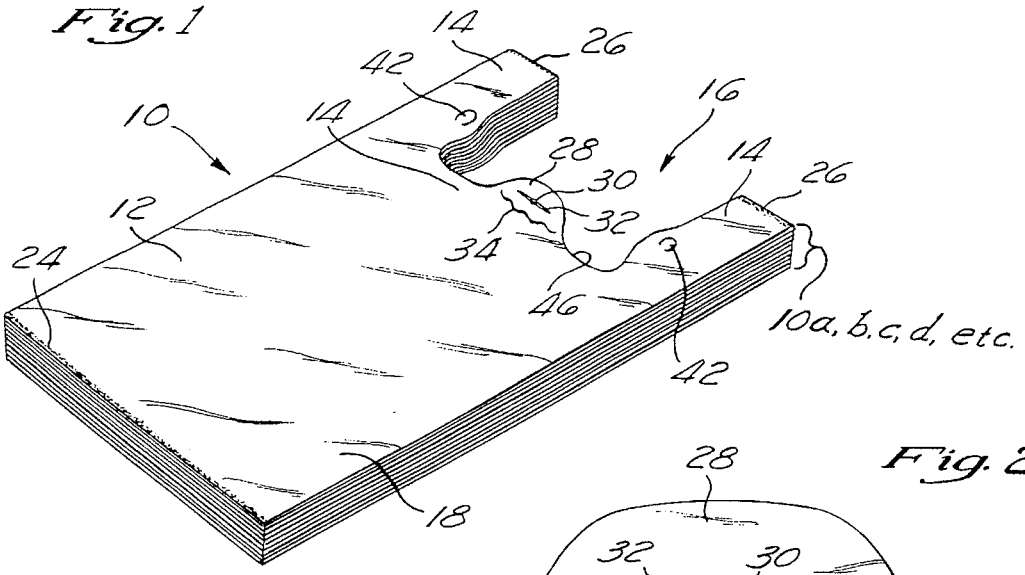
Fig. 2
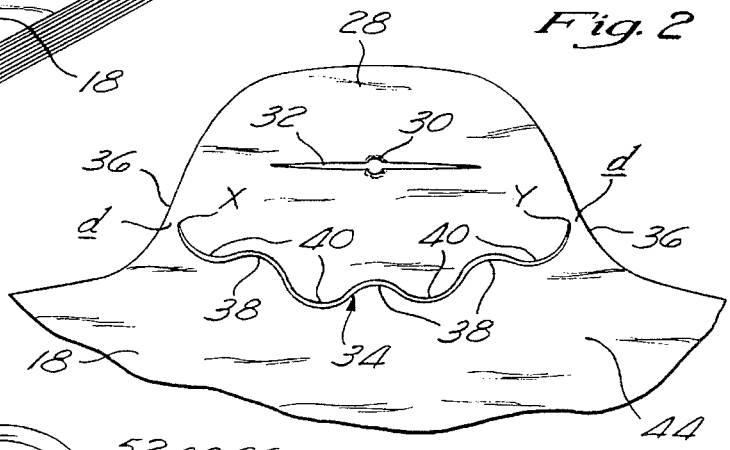
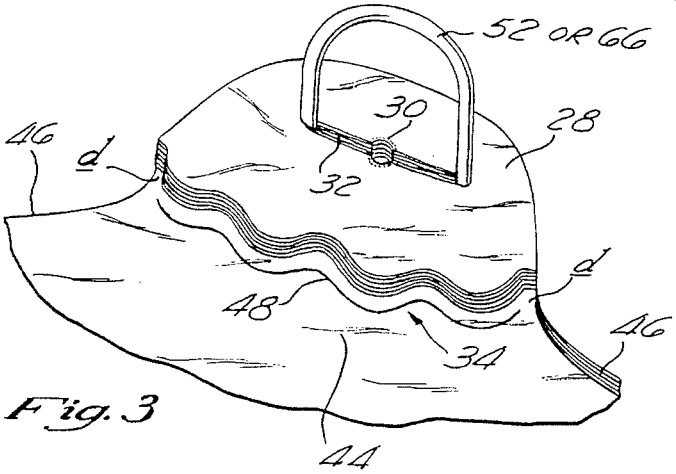
Fig. 3
Fig. 2a
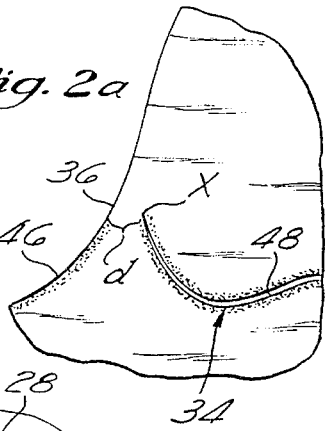
Fig. 4
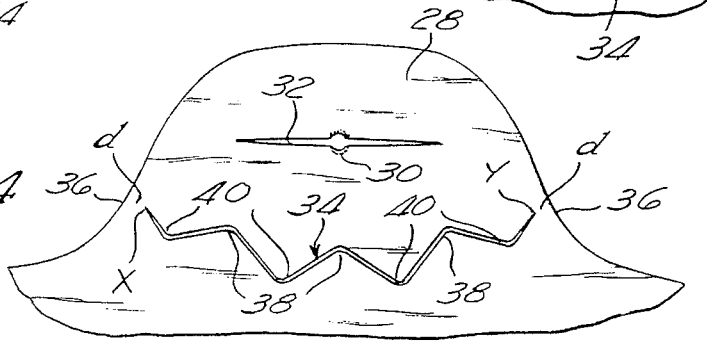

Fig. 5
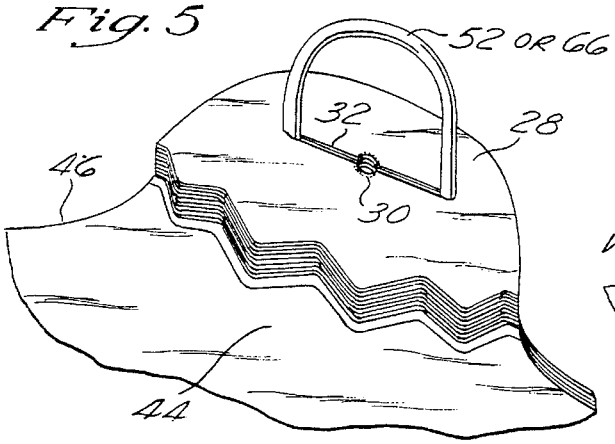
Fig. 6 (PRIOR ART)
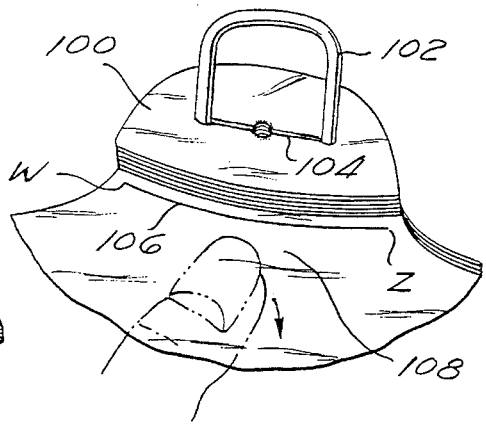
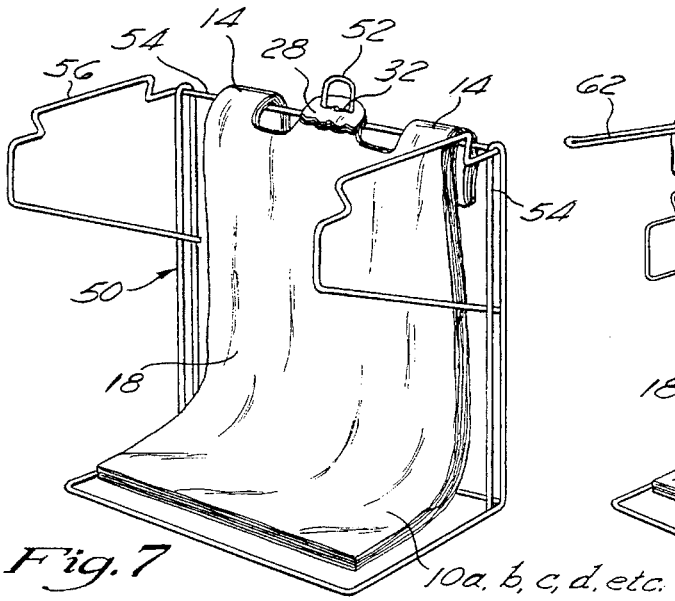
Fig. 7
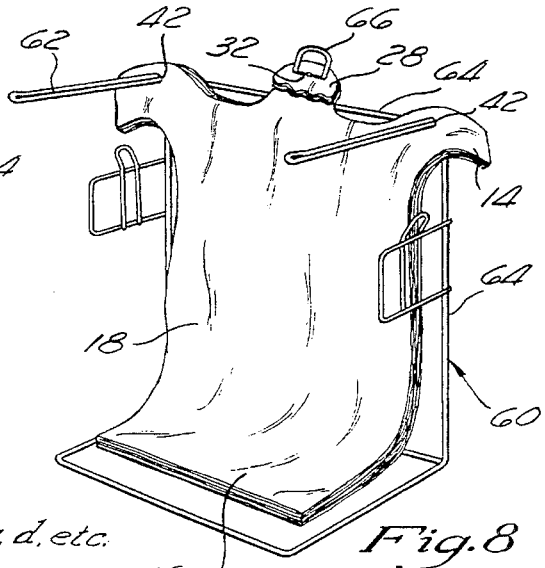
Fig. 8
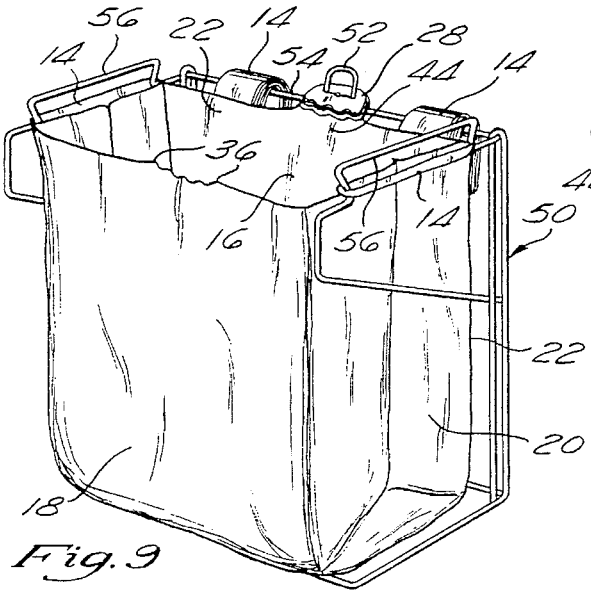
Fig. 9
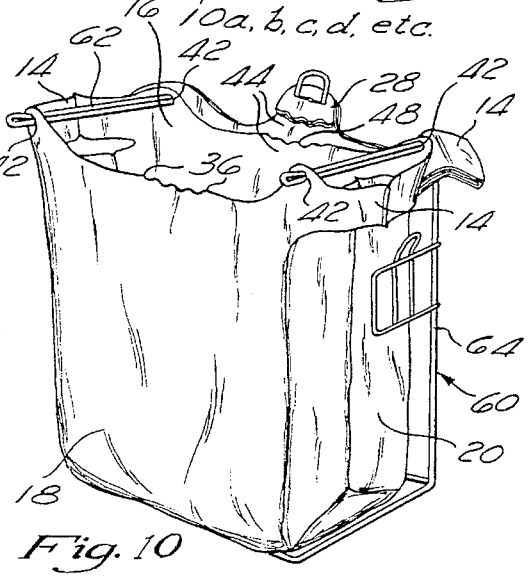
Fig. 10

Fig. 17
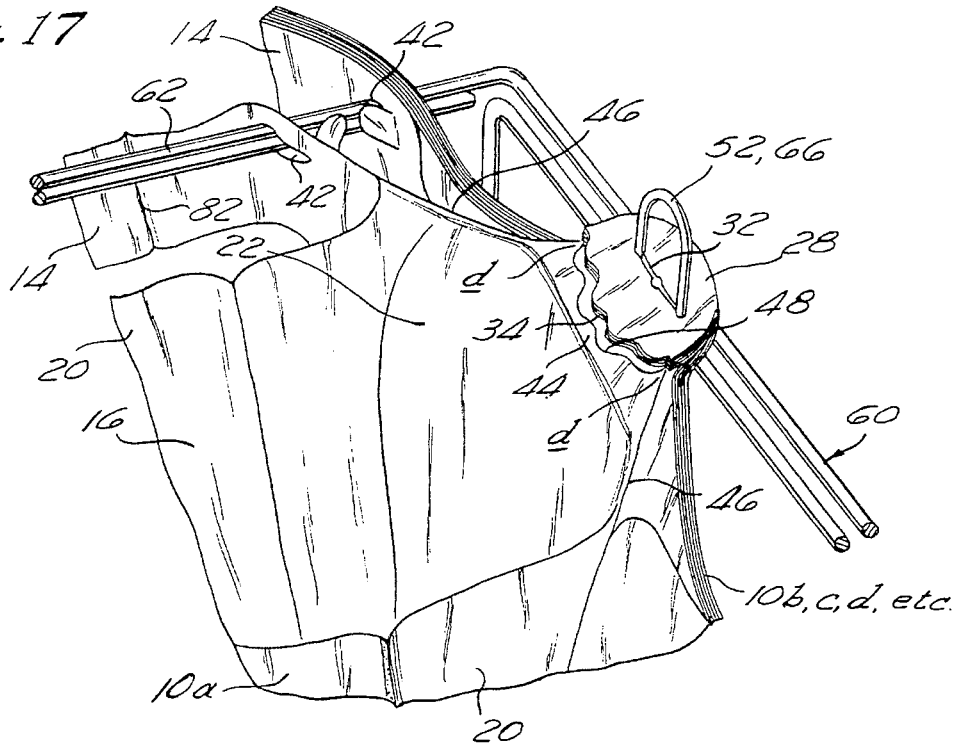
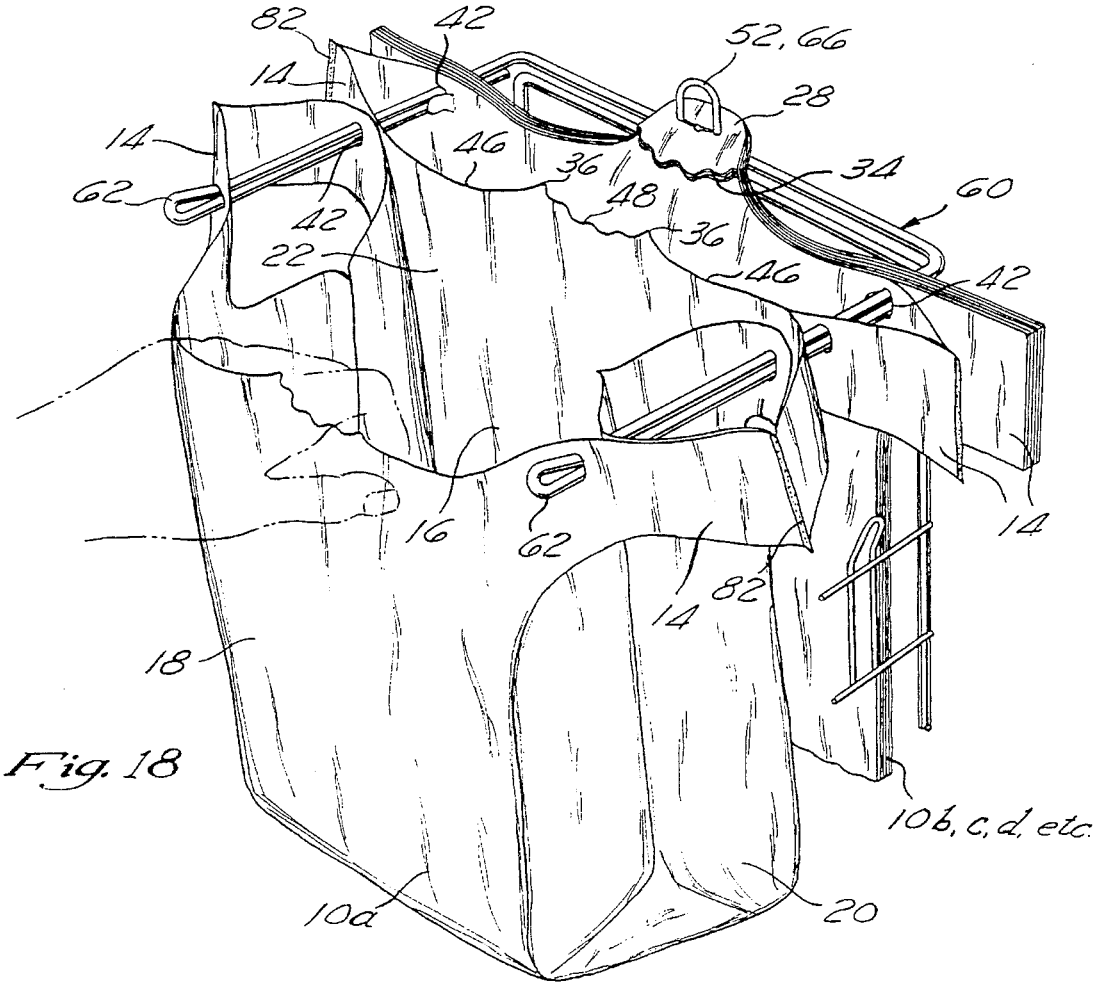
Fig. 18

SELF-OPENING PLASTIC BAG PACK SYSTEM

CROSS REFERENCE TO RELATED APPLICATIONS

This application is a continuation of application number 07/932,333, filed Aug. 19, 1992, now abandoned, which is a continuation-in-part of application Ser. No. 07/904,446, filed Jun. 25, 1992, now abandoned.

BACKGROUND OF THE INVENTION

1. Field of the Invention

This invention relates to plastic bags, and more particularly to a pack of T-shirt bags, merchandise bags, trash bags, and the like made preferably of polyolefins, and method of manufacturing same, which can be used with or without bagging racks and which provide for self-opening of the bags as each bag is removed from the pack of bags.

2. Description of the Prior Art

Since the mid-1980's, the use of plastic shopping bags has grown dramatically due to the great advantage plastic bags have over bags made of other materials, such as paper. Plastic bags are typically made of low or high density polyethylene (LDPE and HDPE, respectively), but can be made of any of the polyolefins. LDPE and HDPE bags are stronger, lighter and much more compact than paper bags when stacked, saving valuable storage space at the merchants' checkout counter and storage areas. These attributes also make these bags less expensive to transport. LDPE and HDPE bags can be manufactured and sold much less expensively than competing paper bags, making them the bags of choice for merchants. LDPE and HDPE bags are also environmentally friendly since they require 70 percent less energy to manufacture than competing paper bags and are readily recyclable, and when not recycled, are non-toxic when incinerated or disposed of in landfills.

Many groceries stores and other merchants now use a style of plastic bag to bag groceries called T-shirt bags. T-shirt bags are pleated bags which are closed, by heat sealing, at a bottom edge, and have a pair of integral handles extending upwardly to define an open mouth of the bag therebetween. The handles make the grocery loaded bags easier to carry. Because high density polyethylene (HDPE) has a greater resistance to stretching and deformation, HDPE is generally used for making T-shirt bags, although LDPE and other polyolefins can also be used. T-shirt bags are normally provided in packs of aligned bags and these packs of bags are often used in conjunction with bagging racks.

T-shirt bags are generally manufactured by the following process. A continuous tube of HDPE, or other plastic materials having the desired color, thickness, and diameter is formed on a extruding machine. The continuous plastic tube is then passed over rollers to roll the continuous plastic tube onto a spool. Depending on whether or not the bags to be formed from the continuous tube of HDPE will be printed on one or both sides, the newly formed continuous tube will be subjected to corona surface treatment, wherein the side or sides of the continuous flattened tube of plastic to be later printed will be passed by a high voltage corona discharge electrode. Corona surface treatment affects electrical and chemical changes on the plastic's outer surface to prepare that surface of the bag for printing. As will be discussed below, corona surface treatment, or other known methods to electrically and chemically change the entire outer surface of the continuous plastic tube, has been found useful to insure reliable and consistent self-opening operation of applicant's plastic bag pack system.

After being corona surface treated and rolled, the roll of continuous plastic tube is then pleated, and then a bagging machine heat seams and cuts sections of the pleated tube at top and bottom edges to form closed and flattened pleated bags of a desired length and width, with the pleated sides being at both sides of the flatted pleated bags. Further downstream of the heat seaming and cutting step, the bags are stacked in aligned piles. Thereafter, a hydraulic die or other cutting methods are utilized to remove material at the stacked bags' top portion to form the handles and a central tab portion with a central tab slit for support of the pack of bags on a hook of a bagging neck and a tearing line below the central tab slit. Usually a heat weld is utilized to hold the stack of central tabs together, thus forming a pack of bags. Each handle will comprise four layers of material since they are cut out from the pleated side portions of the bag.

Despite the many advantages HDPE T-shirt bags have over paper bags, unlike thicker and stiffer paper bags with a discreet flat bottom, they are not self-standing. This is due to their relatively thin and flexible material. In grocery stores settings, where quick and easy loading of bags is desirable, T-shirt bags are provided in stacks or packs which are generally supported on a bagging rack as merchandise is loaded into the bags to overcome the lack of self-standing ability.

There are several popular styles of T-shirt bags available in packs of bags and bagging racks for use therewith, some main types of which will be discussed. In one type of pack of T-shirt bags and bagging racks used therewith, the bagging rack has a support base, a wire rear wall with a tab receiving hook, and two wire arms extending forwardly over the base. In the center top portion of the arms, the wire is formed so as to have a section which will spread and hold apart the handles of T-shirt bags engaged therewith to open up the mouth of the T-shirt bag. The pack of T-shirt bags used with these styles of bagging racks consists of a stack of overlapped and aligned bags which have a lower bag portion with two handles extending upwardly at both sides of the mouth of the bag. A central tab portion is provided on the mouth of the bags between the two handles, and the central tab portions of the pack of bags are heat-sealed together. The heat sealed central tabs thus form a stack or book of central tabs and have a central tab slit formed therethrough. The central tab slit is engaged with the tab receiving hook on the rear wall of the bagging rack, and the book of central tabs will remain engaged therewith, even after individual bags are removed. Below the central tab slit a tearing slit is provided which traverses almost the entire distance of the central tabs except for a small distance at both sides of the central tab portion. The tearing slit allows the individual bags to be torn off the pack of bags as they are needed, and looped onto the bagging rack.

A second major type of pack of T-shirt bag, and bagging rack designed to be used therewith, are disclosed in U.S. Pat. No. RE 33,264 to Baxley, et al. Another version of this style of bagging rack is disclosed in U.S. Pat. No. 4,840,336 to Stroh, et al. Both of these bagging racks have a bottom support base and a rear wire wall with a tab receiving hook located thereon. However, to open up each individual bag for loading, instead of looping the handles of the bags over the top of the support arm one at a time, as is done with the first type of pack of bags and rack, these racks have two handle support rods extending forwardly from the rear wire wall of the rack. The pack of T-shirt bags used with these styles of racks are similar to those used with the first type of rack, except that aligned apertures are formed on each handle of the pack of bags, through which pass the handle support rods of the bagging rack.

Both these styles of packs of T-shirt bags suffer from drawbacks; namely, the lack of a self-opening feature. In order to prepare a T-shirt bag for loading with merchandise, only the first layer of the bag material of the top bag, and no other layers must be pulled forward, thereby opening just the top bag. Since the HDPE material is very thin, typically between 1 to 0.5 mil thick (0.001 and 0.0005 inches), it is sometimes difficult for the checkout clerk or box boy to grasp just the top layer of bag material. One can often see a sponge or source of tacky material, such as a glue stick, retained at the top of bagging racks, with which the checkout clerk or box boy can dampen his or her fingers to aid in grasping just the top layer of material of the bag. However, this takes additional time and effort in the bagging process. This cycle will have to be repeated with each successive bag to be loaded.

Several approaches have been taken to overcome these problems. U.S. Pat. No. RE 33,264 to Baxley, et al. discloses a pack of T-shirt bags wherein spots of adhesive are placed between the rear wall of the forwardly lying bags and the front wall of the rearwardly lying bags. The use of these spots is intended to provide for self-opening of the bags as each bag is pulled off the rack. However, the use of spots of adhesive is undesirable from a cost standpoint because of the requirement of an extra manufacturing step of depositing spots of adhesive on the growing stack of closed bags as each subsequent closed bag is stacked thereon, before the die cutting step takes place.

U.S. Pat. No. 5,074,674 to Kuklies, et al. discloses a packs of bags similar to that of Baxley, et al. wherein the front wall of each bag is either relieved or removed in the region of the central tab so as not to be retained by the tab receiving hook on the bagging rack, purportedly allowing the front wall of the bag to be grasped more easily to open the bag. However, this style also requires an extra, and difficult manufacturing step of removing or relieving a portion of only the front wall of each bag. The pack of bags of Kuklies, et al. does not provide for self-opening of the bags.

U.S. Pat. No. 4,877,473 to Snowden, et al. discloses a pack of bags wherein the tearing line has a central arched portion which forms a sub tab. This sub tab can be easily grasped and pulled forward to pull the front wall of each bag to open that particular bag. However, each subsequent bag in the pack of bags must be opened in the same manner.

Despite the attempts to overcome the problems associated with these presently available T-shirt bags, there remains a need for an improved pack of T-shirt bags which can be used with a variety of bagging racks, which can be easily manufactured, and which provides for self-opening of each bag in the pack of bags.

SUMMARY OF THE INVENTION

The present invention overcomes the above noted deficiencies of the presently available T-shirt bags by providing a new type of T-shirt bag which can be readily used with a variety of different bagging racks, and which provides for self-opening of bags as the immediately forwardly lying bag is removed from the pack of bags.

The present invention provides a pack of self-opening bags for use with bagging racks, comprising:

a plurality of bags, each of said bags having opposed walls with outer surfaces, said outer surfaces being surface treated and aligned in a stack, said opposed walls being closed at a bottom edge and at least partially openable at a top region to define a mouth region, a central tab portion being located on said opposed walls of each of said bags in said mouth region of said bags, said central tab portion having a top edge and side edges, said central tab portion having a tearing cut extending thereacross, except for uncut portions near said side edges of said central tab portion, said tearing cuts being formed through said stack of bags and following a non-straight path, said walls of said pack of bags being held together by frangible bonds along both sides of said tearing cut passing through said central tab portions and by slight static attraction between the outer surfaces of adjacent walls of adjacent bags, said central tab portions in said stack being affixed together above said tearing cut to form said pack of self-opening bags.

The invention further provides a pack of self-opening bags for use with bagging racks, comprising:

a plurality of bags, each bag having a front wall and a rear wall, and surface treated on the outer surface of said front and rear walls;

a rear wall;

side walls joining said front and rear walls, said bags having a bottom edge which is closed and a partially opened top edge;

a pair of integral handles extending upwardly from said top edge with a mouth region located between said integral handles; and central tab portions located on said front and rear walls in said mouth region of said bags, said central tab portions having a top edge and side edges, an aperture for receiving a retaining hook of a bagging rack, and a tearing cut which extends across said central tab portion, except for uncut portions adjacent said side edges of said central tab portion, said tearing cut being located below said aperture, said stack of bags being held together with frangible bonds along both sides of said tearing cut which passes through said central tab portions and by slight attraction between the outer surfaces of adjacent walls of adjacent bags, said central tab portions of said stack of bags being permanently affixed together above said tearing cut; wherein said tearing cuts pass through said stack of bags and follow a non-straight path.

The invention yet further provides a self-opening bag dispensing system comprising:

a bagging rack for mounting a pack of bags and readying for loading individual bags from said packs of bags, said rack comprising;

a rear portion with a bag engaging hook means located thereon;

bag handle engaging means affixed to said rear portion; and a pack of self-opening bags for use with said bagging rack, comprising;

a plurality of bags which are surface treated on their outer surface, aligned in a stack, each bag having a front wall and a rear wall;

side walls joining said front and rear walls, each bag having a bottom edge which is closed and a partially opened top edge;

a pair of integral handles extending upwardly from said top edge, with a mouth region located between said integral handles; and central tab portions located on said front and rear walls in said mouth region of each said bag, said central tab portions having a top edge and side edges, an aperture for receiving said bag engaging hook means, and a tearing cut which extends across said central tab portion, except for uncut portions near said side edges of said central tab portion, said tearing cut being located below said aperture, said stack of bags being affixed together above said tearing cut to form a pack of bags wherein there is frangible pressure bonding along both sides of said tearing cut which passes through said central tab portions and in said handles, and slight attraction between the outer surface of adjacent walls of adjacent bags, so that as a bag of said pack is bags is removed from said bagging rack, an immediately adjacent bag of said pack of bags will be self-opened for loading with merchandise.

The invention further provides a method for forming a pack of self-opening plastic bags mountable on a bagging rack, comprising the steps of:

stacking in alignment a plurality of plastic bags which are surface treated on their outer surfaces; and forming at least one tearing cut in said stack of plastic bags in such a manner that frangible bonds are formed along both sides of said cut.

Finally, the invention provides A pack of self-opening bags for use with bagging racks, comprising:

a plurality of bags which are surface treated on their outer surfaces and aligned in a stack, each bag having walls and being closed at a bottom edge and at least partially openable at a top edge to define a mouth region, a central tab region being located on two opposite walls of said bags in said mouth region of said bags, said central tab region having a tearing cut with two ends extending thereacross, both said ends of said tearing cut terminating near said top edge, said tearing cuts being formed through said stack of bags and following a non-straight path, said walls of said pack of bags being held together by frangible bonds along both sides of said tearing cut passing through said central tab portions and by slight attraction between the outer surface of walls of adjacent bags, said central tab portions in said stack being affixed together above said tearing cut to form said pack of self-feeding bags.

BRIEF DESCRIPTION OF THE DRAWINGS

FIG. 1 is a perspective view of a pack of bags of the invention;

FIG. 2 is a fragmentary view of the central tab area of a first embodiment of the pack of bags of FIG. 1, shown before the pack of bags is loaded on a bagging rack;

FIG. 2*a* is a fragmentary view of the central tab area of the pack of bags of FIG. 1, showing frangible bonding along the tearing cut and top edge of the pack of bags;

FIG. 3 is a fragmentary view of the first embodiment of the pack of bags of FIG. 2 hanging on a hook of a bagging rack;

FIG. 4 is a fragmentary view of the central tab area of a second embodiment of the pack of bags of FIG. 1, shown before the pack of bags is loaded on a bagging rack;

FIG. 5 is a fragmentary view of the second embodiment of the pack of bags of FIG. 4 hanging on a hook of a bagging rack;

FIG. 6 is a fragmentary view of a prior art stack of bags hanging on a hook of a bagging rack;

FIG. 7 is a perspective view of the first embodiment of the pack of bags of FIG. 2 hanging on a first type of bagging rack, before being readied for loading.

FIG. 8 is a perspective view of the first embodiment of the pack of bags of FIG. 2 hanging on a second type of bagging rack, before being readied for loading.

FIG. 9 is a perspective view of the first embodiment of the pack of bags of FIG. 7 hanging on the first type of bagging rack, after being readied for loading.

FIG. 10 is a perspective view of the first embodiment of the pack of bags of FIG. 8 hanging on the second type of bagging rack, after being readied for loading.

FIG. 17 is a top perspective view of the bag being pulled forward from the pack of bags on the bagging rack of FIG. 10;

FIG. 18 is another top perspective view of the bag and pack of bags on a bagging rack of FIG. 17 immediately after being torn from the book of central tabs;

DESCRIPTION OF THE PREFERRED EMBODIMENT

Figure 11:
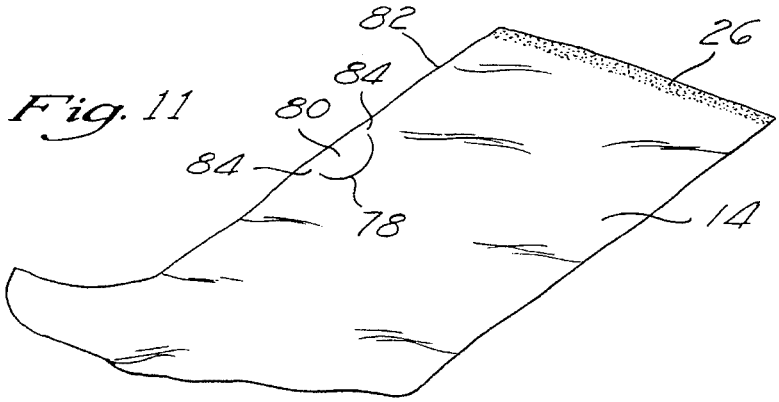
FIG. 11 is a fragmentary view of an alternate embodiment of the handle region of the pack of bags of FIG. 1.
Figure 12:
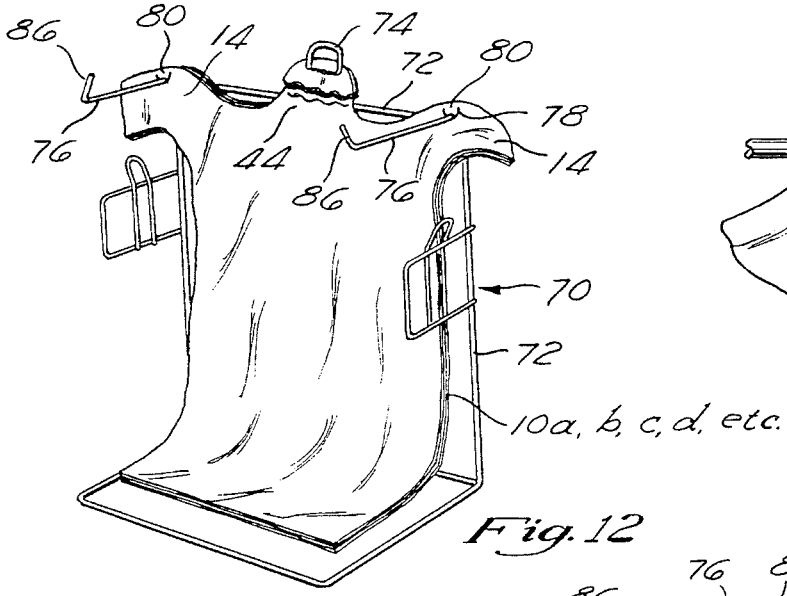
FIG. 12 is a front perspective view of the pack of bags of FIG. 11 loaded on a new style of bagging rack.
Figure 13:
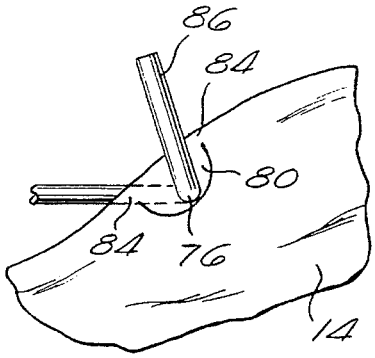
FIG. 13 is a front fragmentary view of the right hook arm of the bagging rack of FIG. 12.

Referring now to the drawings, there is illustrated in FIGS. 1, 7, 9 and 11, various views of the pack of T-shirt bags of the instant invention. The pack of plastic T-shirt bags 10*a, b, c, d,* etc. consists of a stack of overlapped bags 10*a,* 10*b,* 10*c,* 10*d,* etc.; each of which has a lower bag portion 12 with two handles 14 extending upwardly from the lower bag portion 12 at both sides of the mouth 16 of the bags 10*a, b, c, d,* etc. The individual bags 10*a, b, c, d,* etc. have a front wall 18, pleated side walls 20 and a rear wall 22 (see FIG. 9). The T-shirt bags 10 of the invention are heat seamed together at their bottom edges 24 and at their top edges 26 of their handles 14. A central tab portion 28 is provided at the mouth 16 of the bags 10*a, b, c, d,* etc. between the two handles 14, and the central tab portions 28 are heat welded together at 30. The heat sealed central tab portions (central tab region) 28 thus forms a stack or book of aligned central tab portions 28. Hereinafter, the term central tab portion and central tab region may sometimes be used interchangeably.

Figure 20:
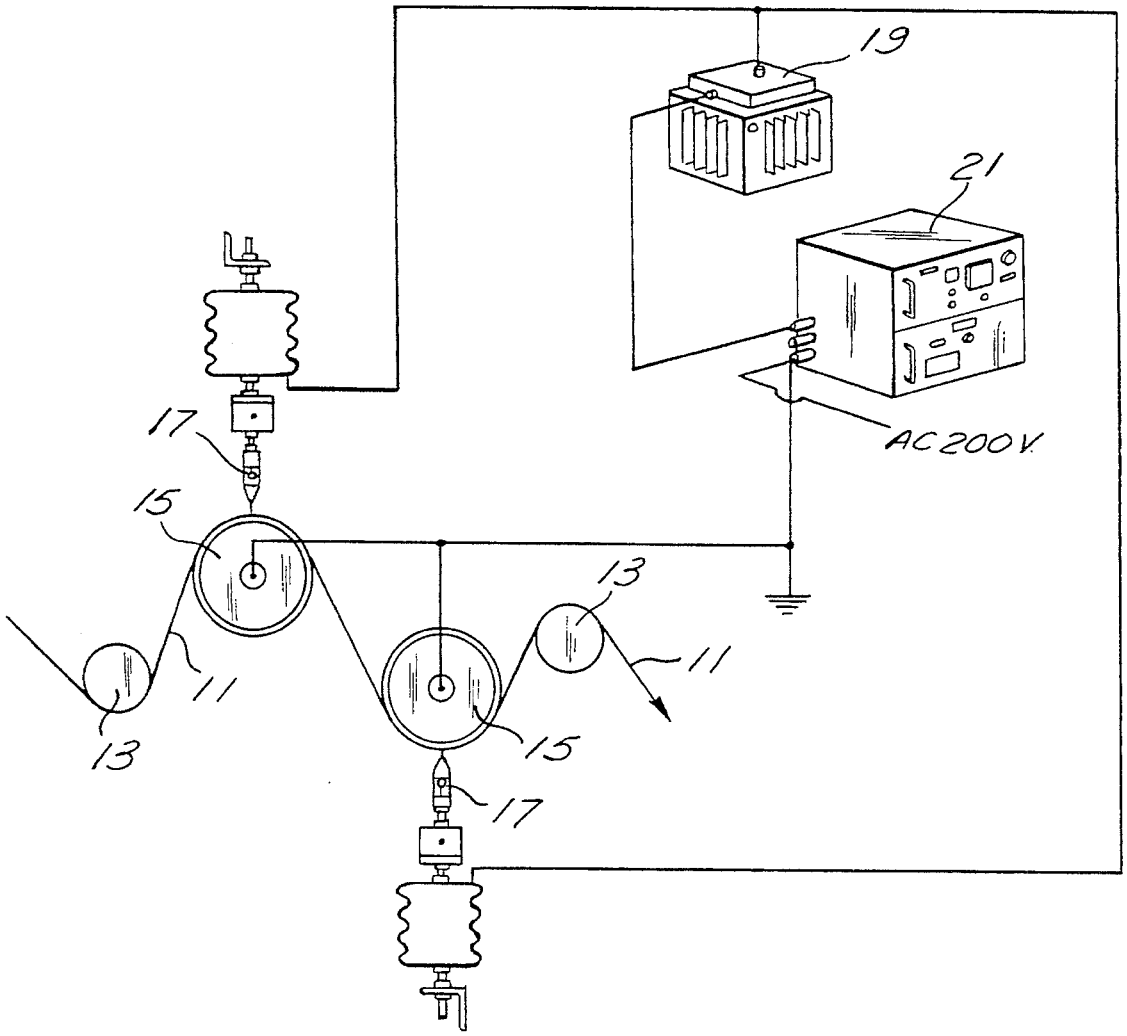
FIG. 20 is a schematic view of the process and mechanism used for corona surface treatment of the continuous tube of plastic material used to form the pack of self-feeding bags of the invention.

Referring to FIG. 20, the individual bags 10*a, b, c, d,* etc. are formed from a continuous tube of plastic material 11 which is treated on its entire outside surface by corona surface treatment. Equipment such as that offered by Kasuga Denki Co., Ltd., of Tokyo, Japan, can be used. The flattened continuous tube of plastic material 11 is passed over guide rollers 13 and treatment rollers 15 which are grounded. Discharge electrode bars 17 are spaced slightly over the flatten continuous tube of plastic material 11 to surface treat the exterior surface of the flattened continuous tube of plastic material 11. The discharge electrode bars 17 are connected to a high voltage supply 19, which is itself connected to an oscillator 21. The corona surface treatment affects the electrical and chemical changes to the outer surface of the continuous tube of plastic material 11 used to form the pack of bags 10*a, b, c, d,* etc. The walls of bags which are made from the corona surface treated continuous tube of plastic material tend to have a slight attraction to each other, and this slight attraction contributes to the self-opening feature of the invention. Other known means can be utilized to create attraction between the outer surfaces of adjacent bags.

A central tab slit 32 passes through the central tab portion 28. Below the central tab slit 32, a tearing cut 34 is formed through the book of central tab portions 28. The heat weld 30 is shown as passing through the central tab slit, but can be formed anywhere above said tearing cut 34. The tearing cut 34 extends from almost the side edge to side edge of the central tab portions 28, except for a small uncut distance d at both sides 36 of the central tab portion 28. Referring to FIGS. 2 and 2*a,* the inventor has found that distance d, measured from the end points X and Y of the tearing cut 34 to the edge 36 of approximately 1 to 3 millimeters is ideal. The tearing cut 34 can be formed as a wavy line following a downwardly directed arc, shown in particular in FIGS. 2 and 3, or as a generally zigzag line following a downwardly directed arc, as shown in FIGS. 4 and 5, or other contours which will result in a tearing cut 34 having a length substantially greater than the straight line distance between its endpoints X and Y. For example, a downwardly directed arc could be utilized. When the tearing cut 34 is formed as a generally wavy or generally zigzag line, the tearing cuts 34 formed will have peaks 38 and valleys 40. The tearing cuts 34 depicted in FIG. 2 has a length approximately 28% longer than the distance between its endpoints X and Y. It is believed that a length of tearing cuts 34 10% or greater than the distance between its endpoints X and Y will function adequately.

The manufacturing process used to manufacture the stack of bags 10*a, b, c, d,* etc of the invention is basically the same as is used to manufacture typical T-shirt bags which use a plastic material which has exposed to corona surface treatment on the outside wall surfaces of the bag and requires no additional steps. It has been found that the use of a cold and somewhat thick and dull die blade (a dull knife block cut) to form the tearing cut 34 by hydraulic pressing gives optimal results to form the pack of bags 10*a, b, c, d,* etc. of the invention, since a cold and somewhat dull die blade will tend to create areas along both sides of the tearing cut 34, particularly at its peaks 38 and valleys 40, where the pack of bags 10*a, b, c, d,* etc. will be cold pressed together, creating frangible pressure bonds between the layers of plastic material, at both sides of the tearing cut 34 with the rear walls 22 of the front bags 10*a* sticking to the front wall 18 of the bag 10*b* immediately behind it. Similarly, a thick and somewhat dull die blade can also be used to cut out the handles 14 of the pack of bags 10*a, b, c, d,* etc. This creates frangible pressure bonding of the rear wall 22 of the handles 14 of the top bag 10*a* to the forward wall 18 of the handles 14 of the next bag 10*b* in the pack of bags 10*a, b, c, d,* etc. Other known methods could also be employed to form these frangible pressure bonds.

The idea behind the shape of tearing cuts 34 will be to increase the length of the tearing cut, and thus increase the frangible bonding strength along the tearing cut 34. Moreover, the shapes of the tearing cut 34 depicted in FIGS. 2–5 will allow the lower portion 44 of the pack of bags 10*a, b, c, d,* etc. to sag downwardly in a relative relaxed manner when the pack of bags 10*a, b, c, d,* etc. is hung from a bagging rack. As will be discussed further below, the ability of the lower portion 44 of the pack of bags 10*a, b, c, d,* etc. to sag downwardly will aid in preventing the frangible pressure bonds along the tearing cuts 34 from being disrupted when the uncut portion d of the bags 10*a, b, c, d,* etc. are torn through.

FIG. 6 is a perspective view of the central tab region 100 of a prior art T-shirt bag, shown hanging by its central tab slit 104 on a central tab receiving hook 102 of a bagging rack. In the prior art T-shirt bags, the tearing cut 106 is formed as a straight line or a gently downwardly curved line, which extends almost to the edges of the central tab 100. Due to the shape of the tearing cut 104 of the prior art bags, the length of the tearing line 104 is equal to or not much greater than the distance between its end points W and Z, and due to the fact that a comparatively thin and sharp die blade is used, there is little or no frangible pressure bonding along both sides the tearing cut 106. Moreover, unlike the tearing cuts 34 of the pack of bags 10*a, b, c, d,* etc. of the invention, there will be little sagging downward and relaxation of the bag portion 108 lying below the tearing cut 106. Thus, a self-opening feature has been absent from prior art packs of bags.

As shown in FIGS. 7 to 10, the pack of bags 10*a, b, c, d,* etc. is hung on the bagging racks 50 and 60 by passing a hook member 52 or 66 located on a back wall 54 or 64 of the bagging rack 50 or 60 through the central tab slit 32 of the book of central tabs 28. When the pack of bags 10*a, b, c, d,* etc. is loaded on the bagging racks 50 and 60, due to the unique shape of the tearing cut 34, the portion 42 of the bags 10*a, b, c, d,* etc. below the tearing line 34 will sag downwardly since most of the tension on the bags 10*a, b, c, d,* etc. will be directed at the uncut portions d. The portion 42, particularly in its central region, will thus be subject to decreased tension.

For use with bagging racks 50 of the type shown in FIGS. 7 and 9, the handles 14 of the pack of bags 10*a, b, c, d,* etc. are laid over the back of the rear wire wall (rear portion) 54.

For use with bagging racks 60 of the type disclosed in FIGS. 8 and 10, cuts 42 are formed in the handles 14 of the pack of bags 10*a, b, c, d,* etc. by die cutting during their manufacture. The handles 14 of the pack of bags 10*a, b, c, d,* etc are loaded onto the bagging rack 60 by passing arms 62 extending forwardly of the rear wall (rear portion) 64 of the rack 60 through the cuts 42 in the handles 14, and then the central tab slit 32 is engaged with a hook 66 on the rear wall 64 of the bagging rack 60. These cuts 42 may be formed by cold block cutting to form frangible bonding along the edges of these cuts 42.

Figure 15:
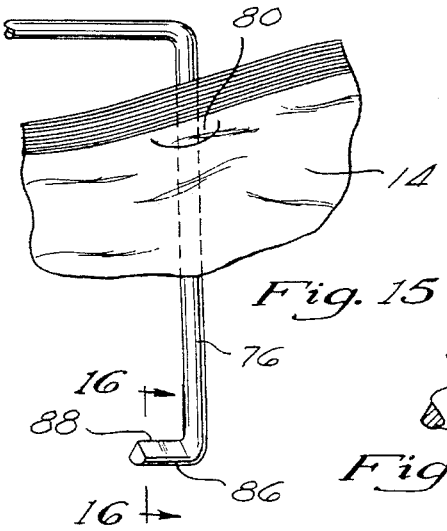
FIG. 15 is a top view of the right hook arm of the rack of FIG. 12.
Figure 16:
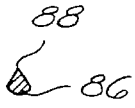
FIG. 16 is a cross-sectional view of the knife edge of the end of the hook arm, through lines 16—16 of FIG. 15.
Figure 14:
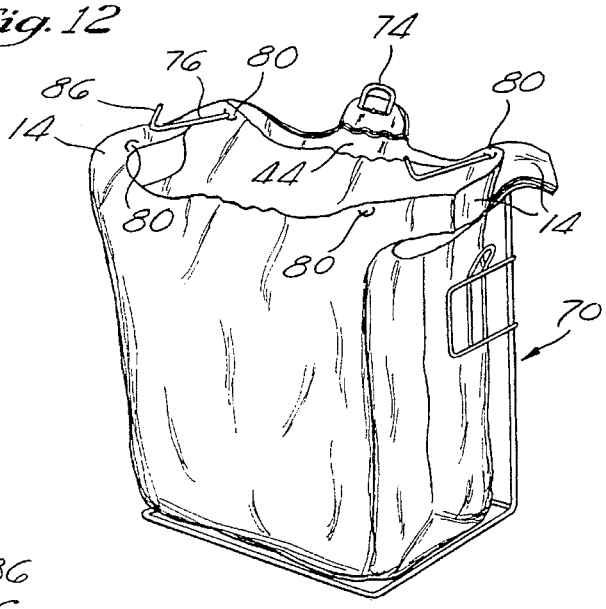
FIG. 14 is a perspective view of the bagging rack of FIG. 12, shown with the top bag in the pack of bags opened up.

Referring to FIGS. 11–16, a new style of bagging rack 70 has a rear wall (rear portion) 72 with a tab receiving hook 74 and two forwardly extending hook arms 76. The pack of bags 10*a, b, c, d,* etc. for use with this style of bagging rack 70 is similar to the pack of bags 10*a, b, c, d,* etc. of FIG. 1 except that it has a "C"-shaped cut 78 which define a "C"-shaped flap 80, located relatively close to the inside edges 82 of each handle 14. Small uncut areas 84, at the terminal ends of the "C"-shaped cuts 78, approximately 2 millimeters wide, provide support for the pack of bags when it is hung on the hook arms 76. These "C"-shaped cuts 78 are ideally formed by cold block cutting to create frangible pressure bonds along the edges of the "C"-shaped cuts 78. The pack of bags 10*a, b, c, d,* etc. with "C"-shaped flaps 80 will be slid over the hook arms 76 by passing the hook arms 76 through the flaps 80 in the handles 14. As shown in FIGS. 15 and 16, the upturned and slightly inwardly directed ends 86 of the hook arms 76 have a cutting blade edge 88 which will assist the layers of bag material being advanced forward to tear through the "C"-shaped flaps 80, thereby freeing those layers of bag material, as shown in FIG. 14.

Although the stack of bags 10*a, b, c, d,* etc. of the invention can be used with any number of available bagging racks, the use of the stack of bags 10*a, b, c, d,* etc. will be described with reference to the most commonly available bagging racks 50 and 60, shown in FIGS. 7–10, and the new bagging rack of FIGS. 11–16.

Referring to FIG. 9, after loading a new stack of bags 10*a, b, c, d,* etc. on the bagging rack 50, the checkout clerk or box boy first grasps only the front wall 18 of the top bag 10*a* and pulls it forward to open the mouth 16 of the bag 10*a*. The front wall 18 only of the top bag 10*a* will be torn free from the pack of bags 10*a, b, c, d,* etc. at its central tab portion 28 along its tearing cut 34 and its uncut portion d, and the rear wall of the bag 10*a* will stay attached to the hook 52 the central tab portions 28 at its uncut portions d. The box boy then manually loops the handles 14 of the top bag 10*a* over handle engaging portions 56 of the rack 50 to retain the mouth 16 of the bag 10*a* in an open position. After the topmost bag 10*a* is loaded with merchandise, its handles 14 are removed from the handle engaging portions 56, and the loaded bag 10*a* is removed from the bagging rack 50. This action causes only the front wall 18 and side wall 20 of the next bag 10*b* in the stack of bags 10*a, b, c, d,* etc. to be pulled forward to open bag 10*b* without the checkout clerk or box boy needing to grasp the material of the top wall 18 of the bag 10*b*. For use with the bagging rack of FIGS. 8 and 10, the process is the same, except that the checkout clerk or box boy just pulls the top bag 10*a* forward on the forwardly extending arms 62 to free the loaded bag 10*a* and to prepare the next bag 10*b* for loading.

This self-opening feature arises mainly out of the frangible bonding along the tearing cut 34 in the central tab, as well as the frangible bonding in the stack of handles 14. It has also been found that corona surface treatment to the entire outside surface of the plastic film used to form the plastic bags of the stack of plastic bags 10*a, b, c, d,* etc. will create slight attraction between adjacent bags 10*a* and 10*b*, 10*b* and 10*c*, 10*c* and 10*d*, etc. The mechanics of this self-opening feature is described below, with reference to a pack of bags 10*a, b, c, d,* etc. hanging on a bagging rack 60 of the kind shown in FIGS. 8 and 10. The mechanics will be the same for other styles of bagging racks.

Figure 19:
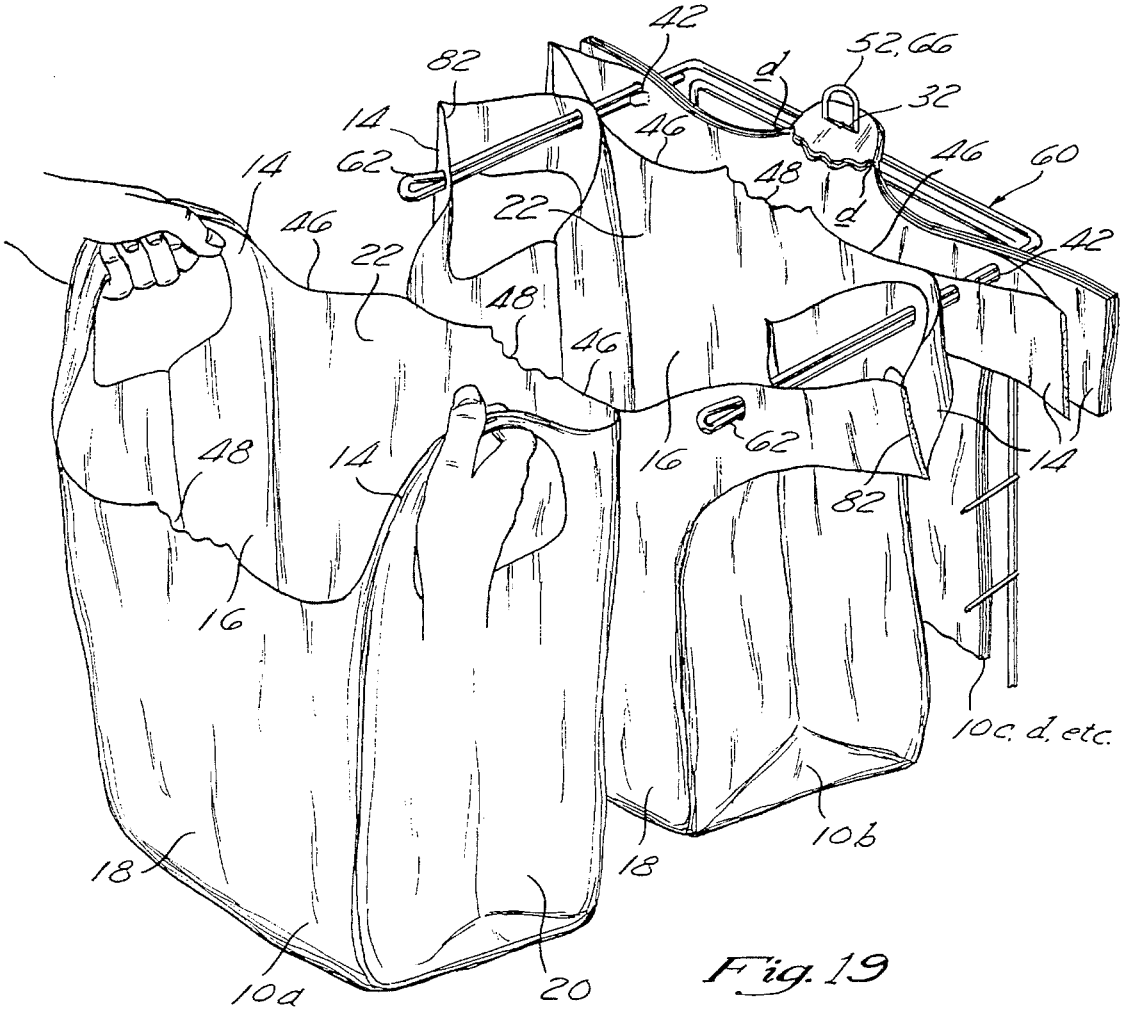
FIG. 19 is a further top perspective view of the bag and pack of bags of FIG. 18, as the top bag is completely removed from the bagging rack and the next bag is prepared for loading.

As best shown in FIGS. 17 to 19, when the forward lying bag 10*a* is pulled forward to remove it from a bagging rack 50, most of the forward pulling tension will be delivered along the top edges 46 of the bags' mouth 16 to uncut areas d at both sides of the tearing cut 34, thereby tearing through uncut areas d. However, because of the frangible bonding of the rear and front layers 18 and 22 of adjacent bags 10*a* and 10*b* along a bottom edge 48 of the tearing cut 34, and the slight attraction between these layers of plastic material, the action of pulling the top bag 10*a* will also pull forward of the front wall 18 of the immediately following bag 10*b*, resulting in the next bag 10*b* in the pack opening up. Thereafter, by merely withdrawing consecutive bags from the top of the pack of bags 10*a, b, c, d,* etc., the bags immediately following will open up without the box boy needing to grasp just the top layer of material 18 of the bag 10*b*. The shape of the tearing cut 34 assists in this mechanism since a tearing cut 34 larger than the straight line distance between its end points X and Y will have greater frangible bonding strength than a straight cut. Moreover, a tearing cut 34 shaped as depicted will, since its lower edge 48 will tend to sag downwardly and will be subject to reduced tension, tend not to transmit the pulling force to the bottom frangibly bonded edge 48 of the tearing cut 34, thereby preserving the frangible bonded edge 48 so that the frangible bonding along 48 will not be destroyed, even after the uncut portions d are torn through. This slight frangible bonding along 48, as well as the slight attraction between adjacent bags, will thus result in the next bag in the pack of bags 10*a, b, c, d,* etc. to be pulled forward, thus creating the self-opening feature of the pack of bags 10*a, b, c, d,* etc., as best depicted in FIG. 19.

It has been found that the frangible pressure bonds in the handles 14 will optimally transmit pulling and tearing tension along the top edges 46 of the bag's mouth 16 to the uncut portions d of both the rear wall 22 of the top bag 10*a* and front wall 18 of the rear bag 10*b* as the top bag 10*a* is pulled forward. This tension will help the uncut portions d tear free at both the rear wall 22 of the front bag 10*a* and the front wall 18 of the rear bag 10*b*. As noted above, the frangible pressure bonding can be formed along the inside edges 82 of the handles 14 and/or the "U"-shaped flaps 42 or "C"-shaped cuts 78 formed in the handles 14. Once again, frangible pressure bonding can be conveniently created by the method of dull block knife cutting, or by other known methods.

The choice of the plastic material used may require slight adjustments in the width of uncut areas d of the tearing cut 34 and/or the uncut area 84 in the "C"-shaped cut 78 in the pack of bags 10*a, b, c, d,* etc. used with the bagging rack 70 since different plastic and polyolefin materials will tend to have different degrees of frangible bonding strength.

If desired, the stack of bags 10*a, b, c, d,* etc. can be looped on the hook 52, 66 or 74 of a rack 50, 60 or 70 through its tearing cut 32 in lieu of the central tab slit 34, with the self-opening feature not being impaired. However, it is preferable to utilized the central tab slit 32 in the pack of central tab portions 28 to avoid possible damage to the frangible pressure bonds formed along the tearing cut 34.

As can be appreciated, the self-opening feature of the pack of bags 10*a, b, c, d,* etc. is accomplished by a simple and reliable method of manufacture.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the following the claims which follow.

I claim:

1. A pack of self-opening bags for use with bagging racks which are adapted to support said pack of self-opening bags in a generally vertical orientation, comprising:

a plurality of bags, each of said bags having opposed front and rear walls with outer surfaces, said outer surfaces being surface treated and aligned in a stack, said opposed walls being closed at a bottom edge and at least partially openable at a top region to define a mouth region, a central tab portion being located on said opposed walls of each of said bags in said mouth region of said bags, said central tab portion having a top edge and side edges, said central tab portion having a tearing cut extending thereacross, except for uncut portions near said side edges of said central tab portion, said tearing cuts being formed through said stack of bags and following a non-straight path, said walls of said pack of bags being held together by frangible bonds adjacent the sides of said tearing cut passing through said central tab portions, wherein said tearing cut is about 10 percent or greater in length than the straight line distance between its endpoints, and is generally downwardly directed relative to said pack of bags carried on the bagging rack so as to allow a portion of the suspended bag pack below said tearing cut to sag downwardly to relieve stress on the frangible bonds formed along the tearing cut, such that when a frontmost lying bag of the pack of bags carried on the bagging rack is removed from the pack of bags, the pulling force applied to remove the frontmost lying bag will be first concentrated on said uncut portions adjacent said tearing cut so that the uncut areas are torn through before the frangible bonds bonding the rear wall of the frontmost lying bag to the front wall of the immediately rearwardly lying bag are broken, so that each successive frontwardly lying bag will pull open the immediately rearwardly lying bag in the bag pack, said central tab portions in said stack being affixed together above said tearing cut to form said pack of self-opening bags.

2. The pack of self-opening bags of claim 1, wherein said central tab portion further comprise a central tab slit above said tearing cut, said central tab slit being engageable with a hook positioned on a bagging rack.

3. The pack of self-opening bags of claim 1, wherein said tearing cut follows a generally sinuspidal path whose axis follows a generally downwardly directed arc.

4. The pack of self-opening bags of claim 1, wherein said tearing cut follows a generally zigzag path which follows a generally downwardly directed arc.

5. The pack of self-opening bags of claim 1, wherein said uncut portions of said central tab are in the range of 1 to 3 millimeters wide.

6. The pack of self-opening bags of claim 1, wherein said bags further comprise a pair of integral handles which extend upwardly at both sides of said mouth.

7. The pack of self-opening bags of claim 1, wherein said bags are pleated.

8. The pack of self-opening bags of claim 1, wherein said central tab portions in said pack of bags are attached together by heat-sealing.

9. The pack of self-opening bags of claim 1, wherein said tearing cut is formed to allow a portion of the pack of bags below said tearing cut to relax downwardly, and thereby relieve stress on the frangible bonds formed adjacent to the tearing cut.

10. The pack of self-opening bags for use with bagging racks of claim 1, wherein said bags are made of high density polyethylene.

11. The pack of self-opening bags for use with bagging racks of claim 9, wherein said bags are made of high density polyethylene.

12. A pack of self-opening bags for use with bagging racks which are adapted to support said pack of self-opening bags in a generally vertical orientation, comprising:

a plurality of stacked bags, each bag having a front wall and a rear wall, and being surface treated on the outer surfaces of said front and rear walls;

side walls joining said front and rear walls, said bags having a bottom edge which is closed and a partially opened top region;

a pair of upwardly extending integral handles with a mouth region located between said integral handles; and central tab portions located on said front and rear walls in said mouth region of said bags, said central tab portions having a top edge and side edges, an aperture for receiving a retaining hook of a bagging rack, and a tearing cut which extends across said central tab portions, except for uncut portions adjacent said side edges of said central tab portion, said tearing cut being located below said aperture, said stack of bags being held together with frangible bonds formed adjacent to the tearing cut, said central tab portions of said stack of bags being permanently affixed together above said tearing cut; wherein said tearing cut passes through said stack of bags and follow a generally downwardly directed non-straight path, which permits the portion of the bags below the tearing cuts to sag downwardly, and thereby relieve stress on the frangible bonds along the tearing cut, such that when a frontmost lying bag of the pack of bags carried on the bagging rack is removed from the pack of bags, the pulling force applied to remove the frontmost lying bag will be first concentrated on said uncut portions adjacent said tearing cut so that the uncut areas are torn through before the frangible bonds bonding the rear wall of the frontmost lying bag to the front wall of the immediately rearwardly lying bag are broken, so that each successive frontwardly lying bag will pull open the immediately rearwardly lying bag in the bag pack.

13. The stack of self-opening bags of claim 12, wherein said central tab portions are attached together by a heat sealed hole.

14. The stack of self-opening bags of claim 12, wherein said uncut portions of said central tab portions are in the range of 1 to 3 millimeters wide.

15. A self-opening bag dispensing system comprising:

a bagging rack for supporting a pack of self-opening bags in a generally vertical orientation and for readying for loading individual bags from said pack of self-opening bags, said bagging rack comprising;

a rear portion with a bag engaging hook means located thereon; and bag handle engaging means affixed to said rear portion; and a pack of self-opening bags adapted for use with said bagging rack, comprising;

a plurality of bags which are surface treated on their outer surface, aligned in a stack, each bag having a front wall and a rear wall;

side walls joining said front and rear walls, each bag having a bottom edge which is closed and a partially opened top region;

a pair of integral handles extending upwardly from said top region, with a mouth region located between said integral handles; and central tab portions located on said front and rear walls in said mouth region of each said bag, said central tab portions having a top edge and side edges, an aperture for receiving said bag engaging hook means, and a tearing cut which extends across said central tab portion and passes through said pack of bags in a generally downwardly directed path, except for uncut portions near said side edges of said central tab portions, said tearing cut being located below said aperture and allowing the portion of the pack of bags below said tearing cut to relax downwardly, wherein frangible pressure bonds are formed along both sides of said tearing cut which frangibly bond together adjacent walls of adjacent bags, and wherein the relaxation of the pack of bags below the tearing cut relieves stress on said frangible bonds, such that when a frontmost lying bag of the pack of self-opening bags carried on the bagging rack is removed from the pack of self-opening bags, the pulling force applied to remove the frontmost lying bag will be first concentrated on said uncut portions adjacent said tearing cut so that the uncut areas are torn through before the frangible bonds bonding the rear wall of the frontmost lying bag to the front wall of the immediately rearwardly lying bag are broken, so that as a bag of said pack is bags is removed from said bagging rack, the intact frangible bonds will cause an immediately adjacent bag of said pack of bags to be pulled opened for loading with merchandise.

16. The self-opening bag dispensing system of claim 15, wherein said tearing cut follows a generally downwardly directed zigzag path.

17. The self-opening bag dispensing system of claim 15, where said bags are made of high density polyethylene.

18. The self-opening bag dispensing system of claim 15, wherein said bag handle engaging means comprises a pair of arm members which extend forwardly of said rear wall of said bagging rack and said pack of bags further comprises openings or flaps which extend in alignment through each handle of said pack of bag, through which said arms members are passed.

19. The self-opening bag dispensing system of claim 18, wherein said pair of arm members have cutting hooks at their ends thereof, and said openings in said handles are "C"-shaped and are located close to inside edges of said handles.

20. The self-opening bag dispensing system of claim 15, wherein said tearing cut follows a generally sinusoidal path whose axis follows a generally downwardly directed arc.

21. The self-opening bag dispensing system of claim 15, wherein said uncut portions of said central tab are in the range of 1 to 3 millimeters wide.

* * * * *